United States Patent [19]

Stagnitto et al.

[11] 4,189,053

[45] Feb. 19, 1980

[54] BULK UNIT OF USE INFORMATIONAL MEDICINAL DISPENSING SYSTEM

[75] Inventors: Frank V. Stagnitto, Denville; James McTiernan, Woodcliff Lake; Morris D. Kamo, Nutley; Walter Antosik, Garfield, all of N.J.

[73] Assignee: Hoffmann-La Roche Inc., Nutley, N.J.

[21] Appl. No.: 6,939

[22] Filed: Jan. 25, 1979

[51] Int. Cl.[2] ..... B65D 83/04

[52] U.S. Cl. ..... 206/570; 206/232; 206/531; 206/534; 206/526

[58] Field of Search ..... 206/570, 232, 531, 534, 206/526, 459, 539

[56] References Cited

U.S. PATENT DOCUMENTS

| | | | |
|---|---|---|---|
| 2,652,149 | 9/1953 | O'Meara | 206/232 |
| 3,494,322 | 2/1970 | Dubbels | 206/534 |
| 3,503,493 | 3/1970 | Nagy | 206/539 |
| 3,515,265 | 6/1970 | Bartnik | 206/534 |
| 3,856,144 | 12/1974 | Kelly | 206/531 |
| 3,899,080 | 8/1975 | Brunda | 206/531 |

*Primary Examiner*—William T. Dixson, Jr.

*Attorney, Agent, or Firm*—Jon S. Saxe; George M. Gould; James H. Callwood

[57] ABSTRACT

A medicinal dispensing system comprising a blister package containing up to 1,000 individual doses of a given medication and a sealable envelope, preferably transparent on one side, for the containment of quantities of medication dispensed as per description is disclosed.

Attached to one side of the envelope are multiple flaps preprinted with information relating to the chemical composition of the drug, contraindications, potentiating effects when used with other medications, etc. On the other side of the envelope is a space for the encoding of dosage information, frequency of administration and other pertinent information concerning the prescription being filled. The blister sheet contains perforations to allow for the detachment of as many individually-packaged doses of medication as are called for to fill a given prescription.

5 Claims, 5 Drawing Figures

BULK UNIT OF USE INFORMATIONAL MEDICINAL DISPENSING SYSTEM

BACKGROUND OF THE INVENTION

1. Field of the Invention

This invention relates to a bulk unit of use informational medicinal dispensing system. More particularly, the invention is concerned with a pharmaceutical dispensing system comprising an envelope having attached to one side multiple, preprinted flaps containing government-required or other information relating to a given medication, space on the opposite side for the encoding of prescription information, and a bulk blister sheet perforated in a manner to allow for easy detachment of individually-packaged doses of medication in quantities called for by the prescription.

2. Description of the Prior Art

Over the past several years, a great deal of concern has been expressed by physicians, regulatory agencies and government officials about the problems of drug abuse in the consumptions of prescription medications. In attempting to address the problems, increasingly stringent regulations have been proposed regarding the need for complete information about the medication, its contraindications, side effects and potential dangers. Ideally, such information should be presented in lay terms and dispensed along with the medications to the patient. The possibility of the passage of such regulations requiring, in some cases, that pages of information be dispensed along with the medication has prompted a great deal of consideration of systems which would provide for the dissemination of detailed drug information while solving the more traditional problems of handling, packaging, storing and keeping records of medications associated with the pharmaceutical industry. Specifically, it is recognized that the ideal system would attain the following objectives:

- provide for drug information in lay terms to be dispensed with the prescription,
- eliminate prescription vials, the space which they occupy and the cost associated with their procurement,
- eliminate the need for cotton and concomitantly eliminate moisture retention and contamination in the prescription vial,
- eliminate cross-contamination by avoiding the use of the same counting tray for a number of different types of medication,
- prevent product mix-up by avoiding the need to return product to a bulk container after counting,
- clear product identification and built-in child resistance for each dosage,
- provision for recording in the patient profile ledger,
- elimination of the need to handle several unit of use sizes,
- preservation of shelf life of medication to the expiration date by eliminating the need for repackaging.

A number of pharmaceutical dispensing systems have appeared in the prior art which have sought to attain the aforedescribed objectives. For example, U.S. Pat. No. 3,958,690 to Gee, Sr. discloses a system for providing identification and medical information together with a dose of medication for emergency use by or for a patient. The system comprises a transparent envelope, a medical identification card and instructions for administration of the medication and a medication-containing package for insertion therein. The system described is primarily directed to convenience and ease of identifying the nature of the illness in an emergency and dispensing to the patient uniform doses of a given medication as limited by predetermined packet sizes geared to providing dosages in the unit of use most frequently described. Any variation of dosage which is not an exact multiple of the unit of use would occasion detachment of one or more individual doses from the predetermined unit of use size and adding said doses to the prescription. The leftover dosages remaining in the impaired unit size package would then be stored for counting and filling future prescriptions.

U.S. Pat. No. 3,305,077 to Grief et al. discloses a pharmaceutical dispensing system wherein a blister package containing individually-packaged doses of medication is provided for insertion into a transparent cellophane envelope. The focal concept of this disclosure is having the dispensing medium itself act as a dose indicating device to remind the user to take or confirm the administration of medicament at specified hours. The system also provides for administration data on an outer, protective sleeve of the package which is inserted into the transparent envelope. Additionally provided with the system is an attached writing instrument.

U.S. Pat. No. 3,958,750 to Prybeck discloses a package formed of three sheets of polyolefin plastic with an open envelope on one side for a hospital medicine card and a closure-equipped flap on the other side for a pouch holding medication. The system additionally provides for a flap to hold a hyperdermic syringe.

U.S. Pat. No. 2,877,893 to Volckening et al. discloses a package for the containment of small articles comprising a plurality of layers of sheet material sealed together with the commodity between them, said package being associated with a label, direction sheet, leaflet or the like bearing indicia or printed matter pertaining to the contents of the package.

In each of the prior art disclosures, it is clear that certain of the aforedescribed objectives have been attained. However, serious drawbacks to each of the prior art systems exist primarily with respect to lack of flexibility in predetermined unit dosage sizes and in lack of provision for complete information relating to the medication to be dispensed along with the medication. Now, in accordance with the present invention, a bulk unit of use informational dispensing system is disclosed which accomplishes the aforedescribed objectives and eliminates the problems associated with the prior art. The terminology "bulk unit of use" is a contradiction in terms in that "unit of use" refers to the packaging of medication in a manner which allows predetermined, prepackaged dosages to be dispensed, and the terminology "bulk" refers to large quantities of a given medication packaged in a manner which allows flexibility in filling dosages of any size. By the practice of the present invention, the flexibility associated with bulk packaging, the avoidance of contamination, easy storage, long shelf life and simplified accounting associated with unit of use packaging are combined with label and preprinted information to provide a system which optimally accomplishes the aforedescribed objectives.

SUMMARY OF THE INVENTION

A pharmaceutical dispensing system which comprises a kit containing:

a. an envelope open at one side and closed at its other three sides, said envelope having:

1. one or more flaps attached to one of its ends for the encoding of preprinted information;
2. space on the opposite side for the encoding of label information;
3. a removable, perforated strip at its open end, said strip having, on one side, space for encoding patient profile information and, on the other side, an adhesive;
4. a foldable strip from which said removable, perforated strip is torn; said strip having, on one side, an adhesive;

b. up to 20 divisible, multi-compartment, separately-releasing dispensing blister packages, said blister packages having:
1. a base perforated in such a manner as to produce 50–100 individually-detachable squares;
2. a paper foil laminate backing and;
3. a plastic bubble on each square for the containment of each individual dosage of medication.

DETAILED DESCRIPTION OF THE INVENTION

Figure 1:
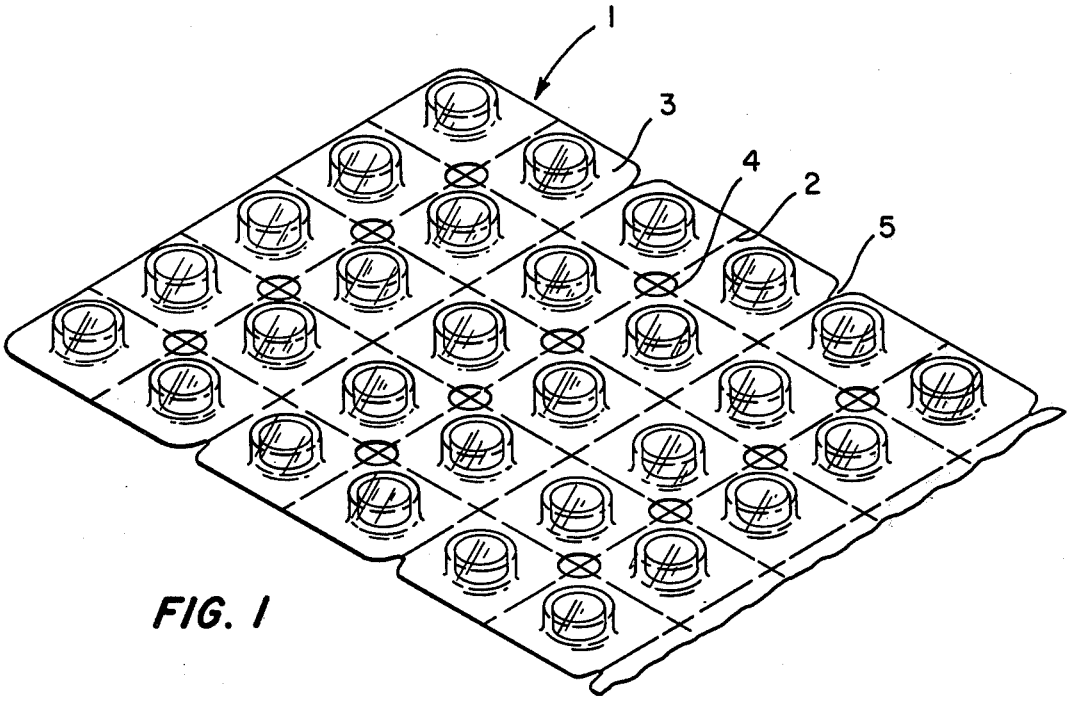
FIG. 1 is a representation of a portion of the blister package showing individual dosages and perforated lines for easy detachment of the number of dosages called for by the prescription. Further, each unit of 10 individual dosages has indentations facilitating easy accountability.

The envelope may be made of any conventional paper material. In a preferredembodiment wherein the envelope is transparent on one side, the sealable, transparent envelope may be made of any conventional, transparent material such as polyethylene, polypropylene or other polyolefins. The adhesive at the bottom for sealing said transparent envelope may be any conventional adhesive. The blister package may be made of any moldable material backed with a paper, foil or any laminate combination and then sealed together by means of a heat-sealable coating. The blister bubble may be made of thermoformable material, or a combination of thermoformable material, bonded together by any combination of mechanical, chemical or adhesive means. Flexible materials may also be used to effect the blister total unit.

The multiple flaps for printing may be of any conventional paper material. In a preferred embodiment, the flaps will be of different lengths, the shortest flap being in the front so that it can easily be seen whether the following flaps have been preprinted with information about the medication. The number of flaps will vary with the medication being dispensed in as much as some medications require that greater amounts of information be disclosed.

The number of individual doses contained in a dispensing kit will be determined by the quantity of individual dosages which is usually dispensed for a given medication. For example, some medications may require that only one dose be administered on a daily basis. Thus, the number of dosages necessary to fill the usual prescription will be small in comparison with medication wherein the dosages are administered three or four times daily. For small dosage medications, the dispensing kit may contain from 50–1,000 individual dosages. For larger dosage medications, dispensing kits having anywhere from 500–1,000 individual dosages would be more practical.

In designing dispensing kits as a function of number of dosages in the usual prescription, the aim is to avoid losses of medication, possible confusion and intermixing of medication, and record keeping associated with smaller unit of use blister packages. For example, it can be appreciated that one could more readily keep track of the dosages remaining in a dispensing package containing multiple blister sheets having 50–100 individual dosages after the administration of a 15-dosage prescription than would be the case if 15 dosages were administered from a blister package originally containing 20 dosages. Thus, the pharmacist would avoid having to keep track of 3, 5, etc. dosages and would avoid the possible intermixing of medications which have similar appearances.

One end of the transparent envelope contains a perforated, removable strip which contains space for patient profile information. The strip, once it is encoded with the proper information, is removed and attached by means of the adhesive to a patient profile ledger. The adhesive remaining on the transparent envelope is used to seal said envelope once the prescription is placed inside by folding over the strip on which the adhesive is contained.

The dispensing system is preferably packaged in a kit, said kit being comprised of a number of blister packages containing dosages in quantities appropriate to the prescription size normally dispensed and a number of transparent plastic envelopes having attached thereto preprinted flaps on one side and provision for label information on the other side. The contents of the kit may be shipped in any conventional shipping material, such as cardboard boxes, in sizes appropriate to the quantities of medication per dosage and the frequency of the prescription. The dispensing system of the present invention may be better understood by reference to the following description of the figures:

FIG. 1 is a representation of a portion of the blister package of the present invention. The number of individual dosages on an individual blister package will be determined by the quantities dispensed in the usual prescription. Quantities ranging from 50–100 dosages per blister package are preferred with quantities of 50 dosages per blister package being especially preferred.

Figure 2:
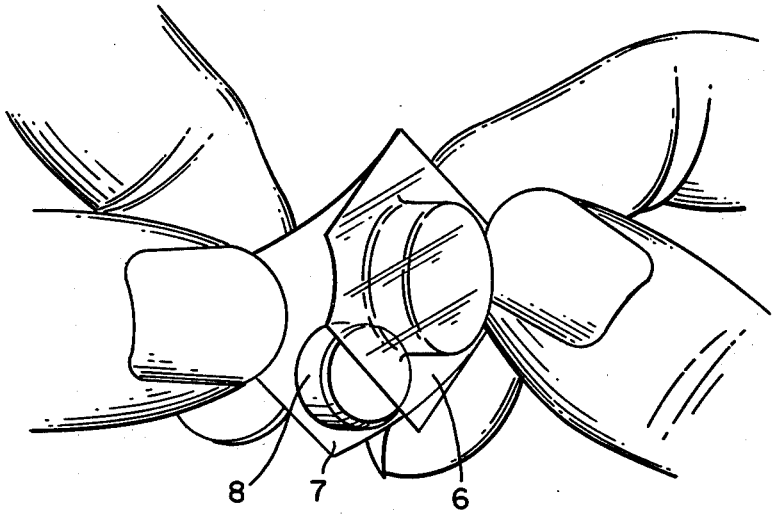
FIG. 2 is a representation of an individual dosage of medication and a preferred methodology for removing each dosage from the individual package.

Perforations, 2, are provided for easy detachment of the dosages. In the view shown are indentations, 5, for detachment of the dosages in multiples of 10. In a preferred embodiment, the blister package is designed to render it "childproof"; i.e., the individual dosages, 3, are housed in compartments which would make it difficult for young children to open them because of their lack of strength and manual dexterity. One method of "child-proofing" is illustrated by number 4 of FIG. 1. Number 4 represents peel-back edges at the juncture of the perforations between each individual dosage. After a dosage is detached at the perforations of the compartment housing, said dosage must be folded back to allow the backing of the compartment to be separated sufficiently to be able to get a firm grip on the backing as shown in FIG. 2. The backing, 7, is detached from blister bubble, 6, to allow the removal of dosage, 8.

Figure 3:
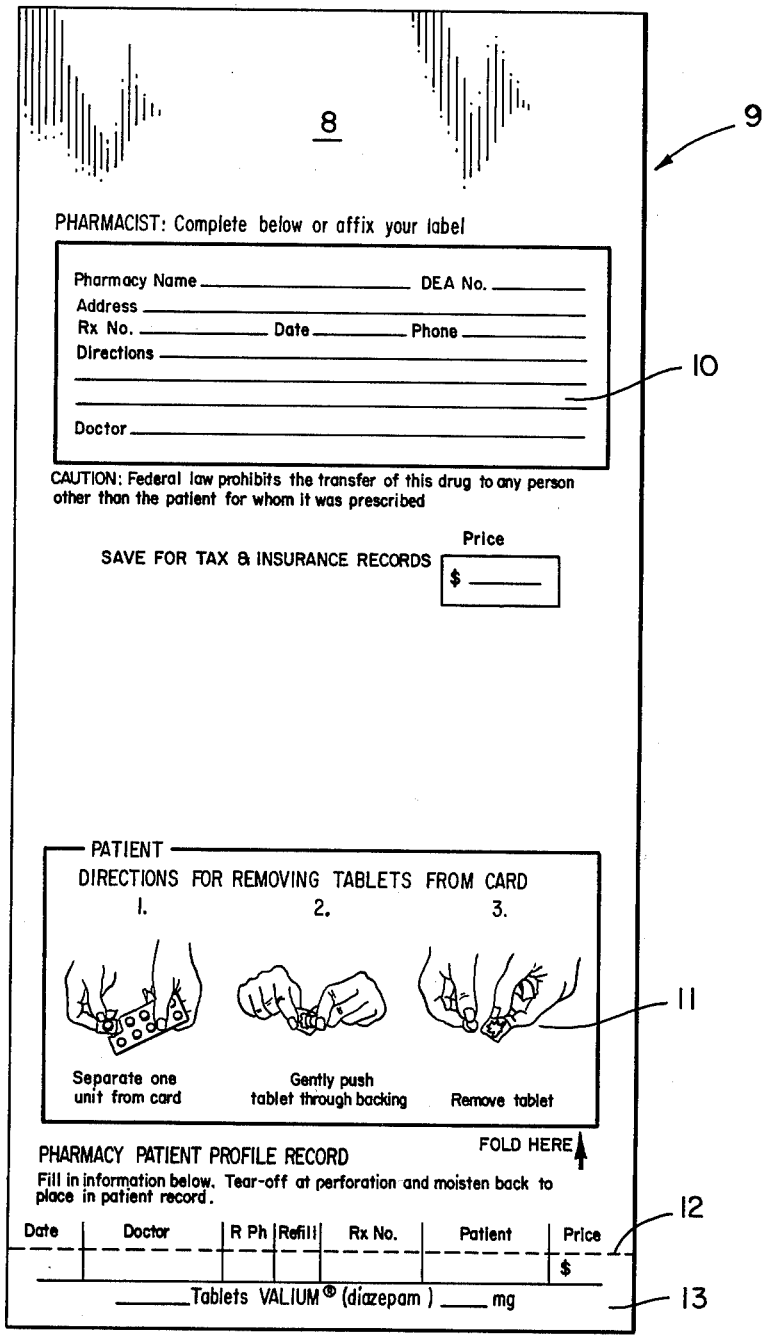
FIG. 3 is a representation of the space on the back of the transparent envelope for the encoding of label information pertaining to a particular description.

FIG. 3 is a representation of the back, 9, of the transparent envelope for containment of the blister package. Space, 10, is provided for label information such as patient name, frequency of administration, etc. Optionally, dispensing instructions, 11, or other useful information may also be displayed. Perforations, 12, are provided for the easy detachment of patient profile strip, 13.

Figure 4:
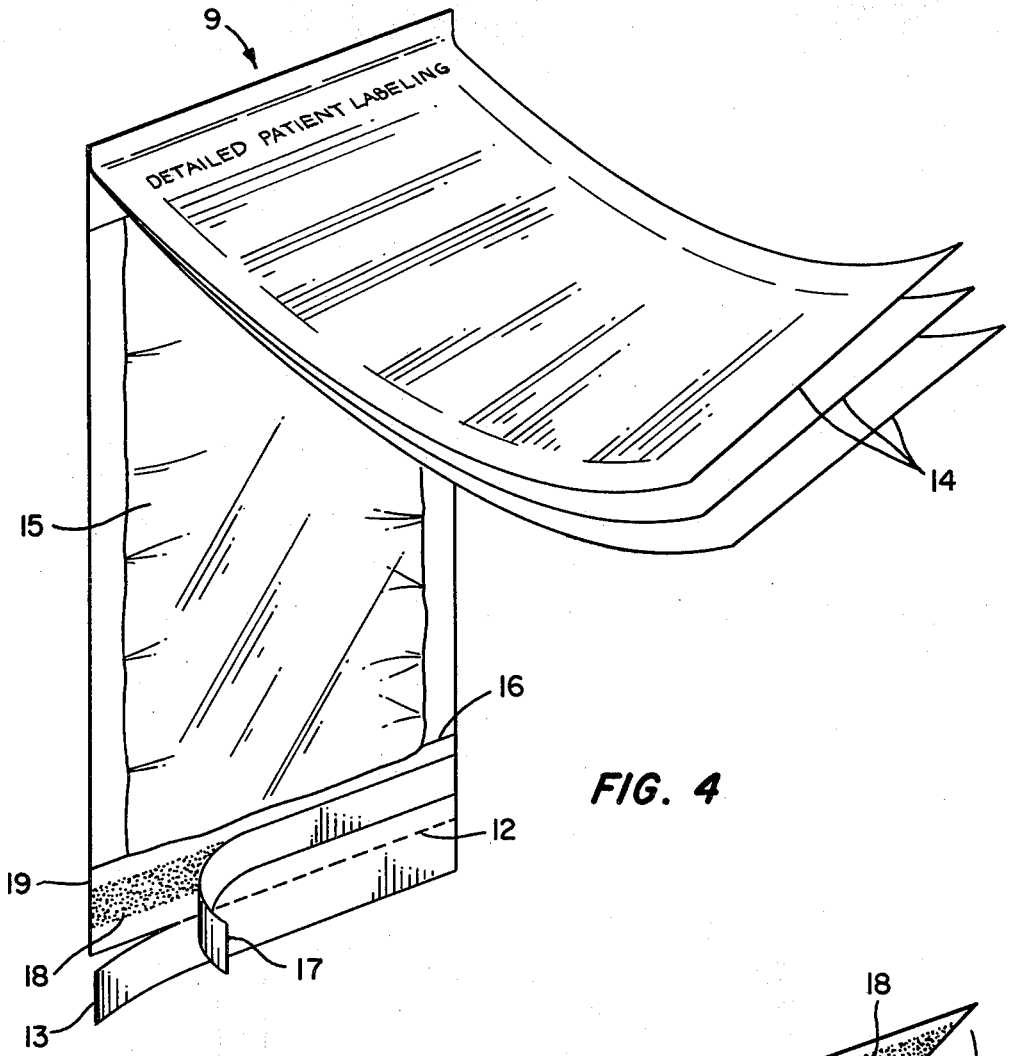
FIG. 4 is a representation of a preferred embodiment of the envelope wherein it is transparent on one side. Additionally representated are preprinted sheets, a perforated, removable strip for patient profile records and a foldable strip on which is contained an adhesive covered by a protective strip.

FIG. 4 is a representation of the front of the transparent envelope. Attached thereto are flaps, 14, which may vary in number from 1 up to as many as are necessary to print all of the required information relating to a given medication. In some cases, 2, 3 or more flaps may be required.

The transparent envelope, 15, is closed at the top and sides and open at the bottom for insertion of the blister package. Perforations, 12, are designed for easy removal of patient profile strip, 13.

Figure 5:
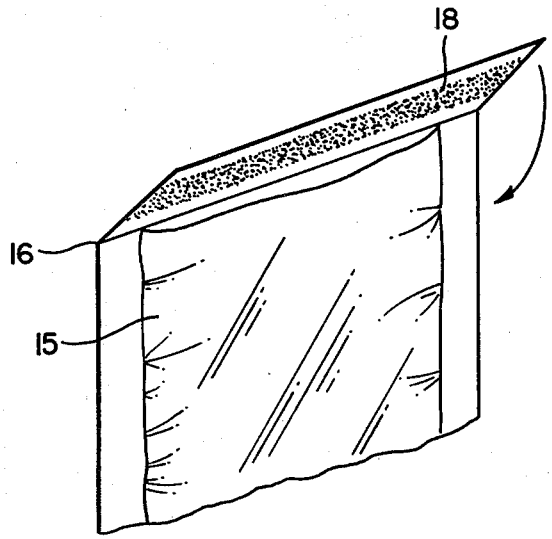
FIG. 5 is a representation of the transparent envelope with the aforementioned, protective strip removed to expose an adhesive for sealing the transparent envelope after the blister package in the correct dosage has been placed therein.

FIG. 5 is a representation of the bottom of blister package, 7. Folds, 15, are designed to allow for easy folding of foldover tab, 18, on which is contained adhesive, 17. Adhesive, 17, is exposed by the removal of adhesive protection strip, 16, as shown in FIG. 4.

What is claimed is:

1. A pharmaceutical dispensing system which comprises a kit containing:

a. an envelope open at one side and closed at its other three sides; said envelope having;
   1. one or more flaps attached to one of its ends for the encoding of preprinted information;
   2. space on the opposite side for the encoding of label information;
   3. a removable, perforated strip at its open end; said strip having, on one side, space for encoding patient profile information and, on the other side, an adhesive;
   4. a foldable strip from which said removable, perforated strip is torn, said strip having, on one side, an adhesive;

b. up to °divisible, multi-compartment, separately-releasing dispensing blister packages, said blister packages having:
   1. a base perforated in such a manner as to produce 50–100 individually-detachable squares;
   2. a paper foil laminate backing and;
   3. a plastic bubble on each square for the containment of each individual dosage of medication.

2. The system of claim 1 wherein said envelope is transparent on one side.

3. The system of claim 2 wherein said kit contains up to 10 blister packages containing 50–100 individual dosages per package.

4. The system of claim 3 wherein the number of flaps for the encoding of preprinted information is 1–3.

5. The system of claim 4 wherein said blister package is child-resistant.

* * * * *

UNITED STATES PATENT AND TRADEMARK OFFICE

CERTIFICATE OF CORRECTION

PATENT NO. : 4,189,053

DATED : February 19, 1980

INVENTOR(S) : Stagnitto et al.

It is certified that error appears in the above—identified patent and that said Letters Patent is hereby corrected as shown below:

Column 6, line 17, "o" should be: 20

Signed and Sealed this

*Twentieth* Day of *May 1980*

[SEAL]

*Attest:*

SIDNEY A. DIAMOND

*Attesting Officer*

*Commissioner of Patents and Trademarks*